United States Patent [19]

Östman

[11] Patent Number: 4,764,251

[45] Date of Patent: Aug. 16, 1988

[54] METHOD FOR THE IMPREGNATION AND COOKING OF LIGNOCELLULOSIC MATERIAL BY A BATCH COOKING USING SPENT IMPREGNATION LIQUOR FROM A PREVIOUS BATCH

[75] Inventor: Per Håkan Östman, Jorvas, Finland

[73] Assignee: Ekono Oy, Espoo, Finland

[21] Appl. No.: 763,840

[22] Filed: Jul. 30, 1985

[30] Foreign Application Priority Data

Nov. 30, 1983 [FI] Finland ..... 834380

[51] Int. Cl.[4] ..... D21C 1/00; D21C 11/00

[52] U.S. Cl. ..... 162/39; 162/60; 162/62

[58] Field of Search ..... 162/39, 43, 44, 45, 162/47, 60, 52, DIG. 2, 248, 249, 62

[56] References Cited

U.S. PATENT DOCUMENTS 2,195,378 3/1940 Dunbar ..... 162/47
2,229,886 1/1941 Dunbar ..... 162/DIG. 2
3,652,384 3/1972 Sluman ..... 162/62
3,679,543 7/1972 Rivers ..... 162/62
4,236,961 12/1980 Green ..... 162/52

*Primary Examiner*—Steve Alvo
*Attorney, Agent, or Firm*—Klarquist, Sparkman, Campbell, Leigh & Whinston

[57] ABSTRACT

A method for the production of cellulose by the batch cooking process, wherein the digester is filled with chips and cooking liquor, and the batch is cooked at elevated temperature and pressure in order to obtain a delignified cellulose pulp in the digester. For the impregnation stage a cooking liquor is used which contains a substantially higher amount of active chemicals than is required for the cooking of the batch, and before the actual delignification stage the active-chemical batch for the cooking is adjusted and the excess amount of active chemicals is removed by replacing it by part of the hot spent cooking liquor recovered from a previous cooking.

16 Claims, 1 Drawing Sheet

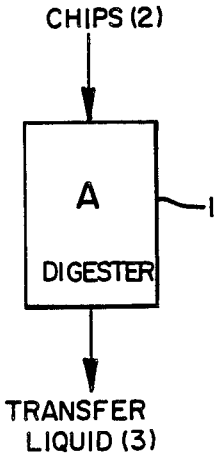

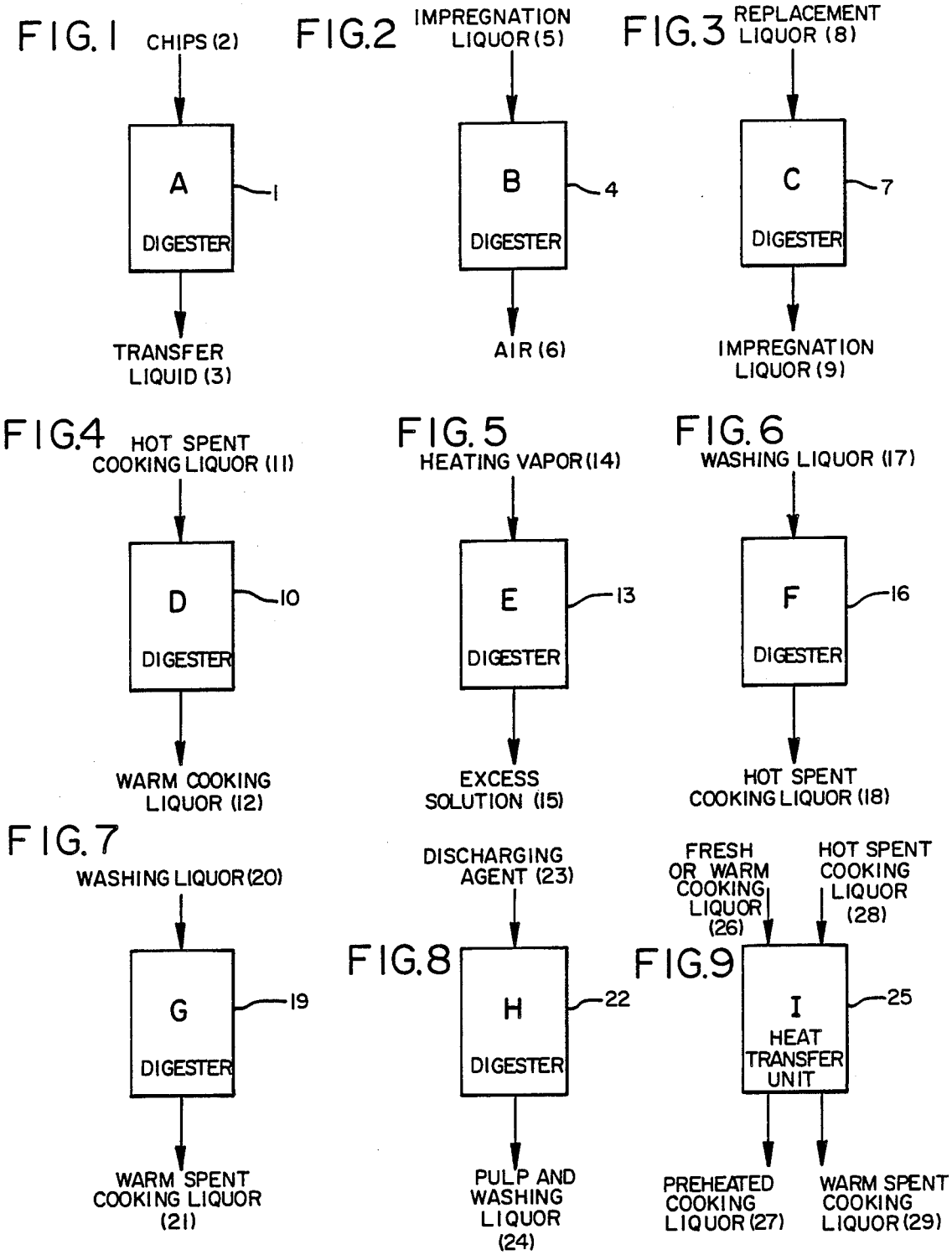
FIG. 1
CHIPS (2)
A
DIGESTER
1
TRANSFER LIQUID (3)
FIG. 2
IMPREGNATION LIQUOR (5)
B
DIGESTER
4
AIR (6)
FIG. 3
REPLACEMENT LIQUOR (8)
C
DIGESTER
7
IMPREGNATION LIQUOR (9)
FIG. 4
HOT SPENT COOKING LIQUOR (11)
D
DIGESTER
10
WARM COOKING LIQUOR (12)
FIG. 5
HEATING VAPOR (14)
E
DIGESTER
13
EXCESS SOLUTION (15)
FIG. 6
WASHING LIQUOR (17)
F
DIGESTER
16
HOT SPENT COOKING LIQUOR (18)
FIG. 7
WASHING LIQUOR (20)
G
DIGESTER
19
WARM SPENT COOKING LIQUOR (21)
FIG. 8
DISCHARGING AGENT (23)
H
DIGESTER
22
PULP AND WASHING LIQUOR (24)
FIG. 9
FRESH OR WARM COOKING LIQUOR (26)
HOT SPENT COOKING LIQUOR (28)
I
HEAT TRANSFER UNIT
25
PREHEATED COOKING LIQUOR (27)
WARM SPENT COOKING LIQUOR (29)

METHOD FOR THE IMPREGNATION AND COOKING OF LIGNOCELLULOSIC MATERIAL BY A BATCH COOKING USING SPENT IMPREGNATION LIQUOR FROM A PREVIOUS BATCH

SUMMARY OF THE INVENTION

The invention relates to a method for the production of cellulose by the batch cooking process, wherein the digester is filled with cellulose-containing material, e.g. chips, and cooking liquor, and the batch is cooked at an elevated temperature and overpressure in order to obtain a deliginified cellulose pulp in the digester. It is the object of the invention to get the cellulose-containing material effectively impregnated with the cooking chemicals before the beginning of the actual cooking process and to reduce the consumption of heat as compared with the processes used so far.

For example, in a normal conventional batch cooking process of sulfate cellulose, the digester is filled with chips, the necessary quantity of white liquor is added and also some black liquor as filler so as to reach the desired liquid to wood ratio. In this case the digester is not completely filled with the liquor but there is free gas space in it. In this case the pressure cannot be freely elevated, but it rises as the temperature of the contents of the digester rises. In this case the passage of chemicals into the chip particles is dependent on diffusion, in which case small chip particles receive chemicals in relatively larger quantities and earlier than do larger particles, and consequently the uniform quality of the pulp deteriorates.

FI patent application No. 820 643 describes a process wherein the entire free space in the digester is filled with liquid, and thus it is possible to raise the digester pressure above the corresponding vapor pressure of the liquid in a state of equilibrium. In the said FI patent application No. 820 643 the liquid used at the impregnation stage is the cooking liquor, already used previously, obtained after the actual cooking process. The active chemical content of this liquor is very low, and so the quantities of active chemicals passing into the chips at the impregnation stage remain relatively small, and most of the cooking chemicals have to pass into the chips or corresponding cellulose-containing material at a later stage by diffusion, which will lead to the larger chip particles being delignified to a lesser degree than the small ones.

As compared with the conventional batch cooking process, the heat economy has been developed in, for example, FI Lay-Open Print No. 63268 and FI patent application No. 820 643.

By means of the invention disclosed in the patent application now presented, effective impregnation of the raw material with the active cooking chemicals and a low consumption of primary heat are achieved by elevating the pressure to the final cooking pressure as early as the impregnation stage and by using as the impregnation liquor a liquor having as high a content of active chemicals as possible, whereupon the amount of active chemicals at the impregnation stage is higher than is required in the actual cooking process, and the excess is removed and used in subsequent cookings by replacing it with hot, spent cooking solution from previous cookings prior to the starting of the delignification stage of the actual cooking.

The main characteristics of the invention are given in the accompanying claims.

The invention is described below in greater detail with reference to the accompanying diagram, wherein the different steps of the present invention are depicted and the different steps are indicated by letters A-I.

BRIEF DESCRIPTION OF THE DRAWING

In the drawing:

FIGS. 1–8 are diagrams showing the flow of materials into and out of a digester; and FIG. 9 is a diagram showing the flow of materials into and out of a heat transfer unit.

DETAILED DESCRIPTION

In the accompanying diagrams, the letters and reference numerals represent:

A Digester at the feeding stage of chips or cellulose-containing material;

2 chips or cellulose-containing material, and the transfer liquid, if any;

3 air out, or alternatively the transfer liquid out.

B Filling with impregnation liquor, if dry feeding of chips is used;

5 warm impregnation liquor which consists of the cooking liquor 12 and warm, unabsorbed impregnation liquor 9, or warm unabsorbed impregnation liquor 9 and fresh, non-preheated cooking liquor;

6 air out.

C Replacement under pressure of warm impregnation liquor by hot replacement liquor;

8 hot replacement liquor in (=fresh cooking liquor 27, which has been obtained by preheating fresh cooking liquor 26 or alternatively cooking liquor 12 from the previous cooking, but which has been preheated with spent cooking liquor 28);

9 warm unabsorbed, impregnation liquor out.

D Replacement under pressure of replacement liquor, and preheating of the chips or cellulose-containing material by means of hot spent cooking liquor, and control of the batching of the active chemicals;

11 the hot spent cooking liquor, which is cooking liquor 18 which has been obtained by replacing the previous cooking by washing liquor 17;

12 warm cooking liquor out.

E Heating to the maximum temperature, and actual cooking (delifnification);

14 heating vapor or equivalent;

15 excess solution and possible gases.

F Replacement under pressure of the hot spent cooking liquor by washing liquor;

17 washing liquor, which has been obtained from the washing of the cellulose pulp;

18 hot spent cooking liquor, possibly mixed with some washing liquor.

G Possibly a second replacement under pressure of the spent cooking liquor by washing liquor;

20 washing liquor;

21 warm spent cooking liquor mixed with some washing liquor.

H Discharging of the cellulose pulp from the digester;

23 the material used for the discharging (solution, vapor, or air);

24 cellulose pulp and the washing liquor passing out together with it.

I Heat transfer unit;

26 fresh cooking liquor and/or cooking liquor 12;

27 preheated cooking liquor;

28 hot spent cooking liquor (part of flow 18);

29 warm spent cooking liquor.

At the beginning of the cooking process the empty digester 1 is filled with a cellulose-containing material such as chips 2, by using either the normally used chip-feeding system or possibly by using the cooking liquor as a transfer medium 2 and 3. In the next step the digester 4 is filled with warm cooking liquor 5, which consists of the cooking liquor 9 and 12 from the previous cookings, or alternatively of the cooking liquor 9 and fresh, non-preheated cooking liquor. Air 6 is removed simultaneously. In the next step the pressure of the digester 7 is increased by adding hot replacement liquor 8, which simultaneously pushes warm unabsorbed impregnation liquor 9 out of the digester. This hot cooking liquor is either hot, fresh cooking liquor 27 which has been obtained by preheating fresh cooking liquor 26, or alternatively the cooking liquor 12 from previous cookings but which has been preheated by means of spent cooking liquor 28 from previous cookings. In the subsequent step the active-alkali batching in the digested 10 is adjusted to its desired value by replacing excess warm cooking liquor 12, using hot spent cooking liquor 11 as the replacing liquor, the liquor 11 being cooking liquor 18 which has been obtained by replacing the previous cooking by washing liquor 17. The hot spent cooking liquor 18 in question preheats the cellulose-containing material (e.g. chips) in the digester.

In the next step the digester 13 is heated to its final delignification temperature by means of heating material 14 while simultaneously circulating the liquor content of the digester through the cellulose-containing raw material. The excess solution and the gases 15, if any, are removed during the heating in such a way that the pressure remains approximately constant.

When the desired degree of delignification has been reached in the digester 16 and possibly 19, the hot spent cooking liquor 18 and possibly 21 is removed under pressure by replacing it by washing liquor 17 and possibly 20, which has been obtained from the washing of the cellulose pulp after the cooking.

When so desired, the hot spent cooking liquor which has been removed can be divided into two parts, one stronger and hotter 18 and the other more dilute and colder 21.

The emptying of the digester 22 of cellulose pulp and of the washing liquor 24 leaving together with the pulp is carried out in the subsequent step by using washing liquor, vapor or compressed air 23 as an auxiliary material for the emptying.

Hot spent cooking liquor 18 is directed under pressure, after leaving the storage tank, as heating solution 28 to the heat transfer unit 25, from which it leaves, cooled, as solution 29.

Into the same heat transfer unit 25 there is directed cooking liquor 26, which is a fresh cooking liquor containing active chemicals, or the above-mentioned cooking liquor 12, which is preheated and leaves as cooking liquor 27.

The warm, unabsorbed impregnation liquor 9 and other cooking liquors, 12 and 15 removed from the impregnation stages contains extracted substances in insoluble form, which can be removed before the liquors in question are used for the impregnation stage of the subsequent cookings.

The advantages of the invention as compared with the current state of the art are:

(a) The impregnation of the active chemicals into the chhips or cellulose-containing pulp is rapid and effective, thus ensuring a better pulp quality.

(b) The negative effect of variation in the moisture content of the chips on the quality of the pulp can for the most part be eliminated.

(c) The impregnation temperature and period can be freely chosen optimally according to the quality criteria for the desired cellulose (for example, pulps for special purposes) and on the basis of the quality properties of the raw material used.

(d) The consumption of heat is substantially lower than in the alternative methods used so far. Compared with the normal sulfate batch cooking process the consumption of heat is only about one-third.

(e) It is possible to separate the extracted materials contained in the chips or cellulose-containing pulp even before the actual cooking process by separating them directly from the cooking solution.

(f) The filling of the digester with chips or other cellulose-containing material can be carried out not only by using the conventional chip-feeding system but alternatively by pumping in such a way that the cooking liquor is used as the circulating transfer liquor. In this case it is possible to increase the degree of filling of chips and effectively separate the non-desirable impurities present in the raw material, such as stones and sand, without increasing the consumption of heat for the cooking.

I claim:

1. A method for the production of cellulose with a high content of alpha- and hemicellulose by the batch cooking process, the method comprising:

forming a batch by substantially filling the space in a digester with lignocellulosic containing material;

impregnating the lignocellulosic containing material by filling the remaining space in the digester with an alkaline impregnation liquor, the active-chemicals content of which is substantially higher than required for cooking of the batch, the impregnation liquor being formed by combining a liquid containing fresh active chemicals and unabsorbed impregnation liquor recovered from the impregnating stage of a previous batch, only a portion of the active chemicals of this unabsorbed impregnation liquor having been spent during the impregnating stage of the previous batch;

preheating a replacement liquor using heat from a portion of hot spent cooking liquor received from a previous batch, which portion is not used for replacing the excess content of active-chemicals, the replacement liquor having an active-chemicals content less than that of the impregnation liquor, the replacement liquor being selected from the group consisting of fresh liquors which contain active chemicals and recovered liquors, the active chemicals of which have been spent only in part during use in a previous batch;

after impregnating, removing the excess active-chemicals content of liquid in the digester by displacing the unabsorbed impregnation liquor by the preheated replacement liquor; and after removing the excess active-chemicals content, cooking the batch at an elevated temperature and at over-pressure in order to obtain in the digester a delignified cellulose pulp and hot spent cooking liquor.

2. A method according to claim 1, characterized in that the pressure in the digester is raised to the final cooking pressure already at the time of starting the displacing of the impregnation liquor from the digester.

3. A method according to claim 1 or 2, characterized in that, after the cooking, the hot spent cooking liquor is recovered under pressure by replacing it by washing liquor obtained from washing a previous batch of lignocellulosic containing pulp.

4. A method according to claim 3, characterized in that the active-chemical batching of the cooking is controlled by:

measuring the concentration of active chemicals in the partly spent cooking liquor leaving the digester; and adjusting the quantity of the hot spent cooking liquor fed in, and respectively the amount of the partly spent cooking liquor to be removed, on the basis of the concentration measured.

5. A method according to claim 4, characterized in that the filling of the digester with lignocellulosic containing material is carried out by pumping, in which case impregnation liquor is used as the circulating transfer liquid.

6. A method according to claim 1 or 2, characterized in that the active-chemical batching of the cooking is controlled by:

measuring the concentration of active chemicals in the partly spent cooking liquor leaving the digester; and adjusting the quantity of the hot spent cooking liquor fed in, and respectively the amount of the partly spent cooking liquor to be removed, on the basis of the concentration measured.

7. A method according to claim 6 characterized in that the filling of the digester with lignocellulosic containing material is carried out by pumping, in which case impregnation liquor is used as the circulating transfer liquid.

8. A method according to claim 1 or 2, characterized in that the filling of the digester with lignocellulosic containing material is carried out by pumping, in which case impregnation liquor is used as the circulating transfer liquid.

9. A method for the production of cellulose with a high content of alpha- and hemicellulose by the batch cooking process, the method comprising:

forming a batch by substantially filling the space in a digester with lignocellulosic containing material;

impregnating the lignocellulosic containing material by filling the remaining space in the digester with alkaline impregnation liquor, the active-chemicals content of which is substantially higher than required for cooking of the batch, the impregnation liquor including unabsorbed impregnation liquor recovered from the impregnating stage of a previous batch, in which previous batch a fresh chemical solution was added hot as the last replacement liquor;

preheating a replacement liquor using heat from a portion of hot spent cooking liquor received from a previous batch, which portion is not used for replacing the excess content of active-chemicals, the replacement liquor having an active-chemicals content less than that of the impregnation liquor, the replacement liquor being selected from the group consisting of fresh liquors which contain active chemicals and recovered liquors, the active chemicals of which have been spent only in part during use in a previous batch;

after impregnating, removing the excess active-chemicals content of liquid in the digester by displacing the unabsorbed impregnation liquor by the preheated replacement liquor; and after removing the excess active-chemicals content, cooking the batch at an elevated temperature and at over-pressure in order to obtain in the digester a delignified cellulose pulp and hot spent cooking liquor.

10. A method according to claim 9, characterized in that the pressure in the digester is raised to the final cooking pressure already at the time of starting the displacing of the impregnation liquor from the digester.

11. A method according to claim 9 or 10, characterized in that, after the cooking, the hot spent cooking liquor is recovered under pressure by replacing it by washing liquor obtained from washing a previous batch of cellulose-containing pulp.

12. A method according to claim 11, characterized in that the active-chemical batching of the cooking is controlled by:

measuring the concentration of active chemicals in the partly spent cooking liquor leaving the digester; and adjusting the quantity of the hot spent cooking liquor fed in, and respectively the amount of the partly spent cooking liquor to be removed, on the basis of the concentration measured.

13. A method according to claim 12, characterized in that the filling of the digester with lignocellulosic containing material is carried out by pumping, in which case impregnation liquor is used as the circulating transfer liquid.

14. A method according to claim 9 or 10, characterized in that the active-chemical batching of the cooking is controlled by:

measuring the concentration of active chemicals in the partly spent cooking liquor leaving the digester; and adjusting the quantity of the hot spent cooking liquor fed in, and respectively the amount of the partly spent cooking liquor to be removed, on the basis of the concentration measured.

15. A method according to claim 14, characterized in that the filling of the digester with lignocellulosic containing material is carried out by pumping, in which case impregnation liquor is used as the circulating transfer liquid.

16. A method according to claim 9 or 17, characterized in that the filling of the digester with lignocellulosic containing material is carried out by pumping, in which case impregnation liquor is used as the circulating transfer liquid.

* * * * *

UNITED STATES PATENT AND TRADEMARK OFFICE

CERTIFICATE OF CORRECTION

PATENT NO. : 4,764,251

DATED : August 16, 1988

INVENTOR(S) : Per Hakan Ostman

It is certified that error appears in the above-identified patent and that said Letters Patent is hereby corrected as shown below:

In the Specification:

Column 2, line 47: "delifnification" should be --delignification--;

Column 3, line 23: "digested" should be --digester--.

In the Claims:

Claim 7, line 1: "6" should be --6,--;

Claim 16, line 1: "17" should be --10--.

Signed and Sealed this

Nineteenth Day of December, 1989

*Attest:*

JEFFREY M. SAMUELS

*Attesting Officer* *Acting Commissioner of Patents and Trademarks*